US006979173B2

(12) United States Patent
Tiemann

(10) Patent No.: US 6,979,173 B2
(45) Date of Patent: Dec. 27, 2005

(54) TURBINE BLADE OR VANE

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/418,160

(22) Filed: Apr. 18, 2003

(65) Prior Publication Data

US 2005/0106011 A1 May 19, 2005

(30) Foreign Application Priority Data

Apr. 18, 2002 (DE) ..... 102 17 390

(51) Int. Cl.[7] ..... F01D 5/18; F01D 9/04

(52) U.S. Cl. ..... 415/191; 415/115; 415/208.1; 415/208.2; 415/210.1; 416/96 R; 416/193 A; 416/232; 416/248

(58) Field of Search ..... 416/193 A, 96 R, 416/96 A, 97 R, 232, 233, 248; 415/115–116, 415/191, 208.1, 208.2, 209.4, 210.1

(56) References Cited

U.S. PATENT DOCUMENTS 2,861,775 A 11/1958 Whitehead
5,165,852 A * 11/1992 Lee et al. ..... 416/97 R
5,954,475 A * 9/1999 Matsuura et al. ..... 415/115
6,019,579 A 2/2000 Fukuno et al.
6,158,962 A * 12/2000 Lee et al. ..... 416/193 A
6,354,797 B1 * 3/2002 Heyward et al. ..... 415/191
2002/0012589 A1 1/2002 Dailey

FOREIGN PATENT DOCUMENTS

EP 0 661 414 7/1995
EP 0 940 561 9/1999
FR 969 414 12/1950
GB 926084 A * 5/1963 ..... 416/96 R
GB 1230325 A * 4/1971 ..... 415/116

OTHER PUBLICATIONS

European Search Report dated Feb. 10, 2005, EP Appl. No. 03 00 6497.

* cited by examiner

*Primary Examiner*—Christopher Verdier
(74) *Attorney, Agent, or Firm*—Harness, Dickey & Pierce, P.L.C.

(57) ABSTRACT

A turbine blade or vane includes an inner contour profile which is matched to the contour profile of the outer transition region, so that a substantially uniform blade or vane wall thickness is achieved.

5 Claims, 2 Drawing Sheets

TURBINE BLADE OR VANE

The present application hereby claims priority under 35 U.S.C. §119 on German patent application number DE 10217390.7 filed Apr. 18, 2002, the entire contents of which are hereby incorporated herein by reference.

FIELD OF THE INVENTION

The present invention generally relates to turbine blades or vanes.

BACKGROUND OF THE INVENTION

Hollow turbine blades or vanes, in particular gas turbine blades or vanes, in the region of a transition from the main blade or vane region to the platform, have, on an outer surface, a curvature which is necessary in terms of loading and casting technology; at this transition, there are local accumulations of material which are difficult to cool by a cooling medium in the interior.

SUMMARY OF THE INVENTION

An object of the present invention to provide a turbine blade or vane in which the transition region from the main blade or vane region to the platform can be cooled successfully.

According to an embodiment of the present invention, an object is achieved by providing a turbine blade or vane. In particular, a contour profile of a cavity or of an inner passage in the interior of the turbine blade or vane is matched to a contour profile of the outer transition, in such a manner that a substantially uniform thickness is formed.

Further scope of applicability of the present invention will become apparent from the detailed description given hereinafter. However, it should be understood that the detailed description and specific examples, while indicating exemplary embodiments of the present invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE EXEMPLARY EMBODIMENTS

Figure 2:
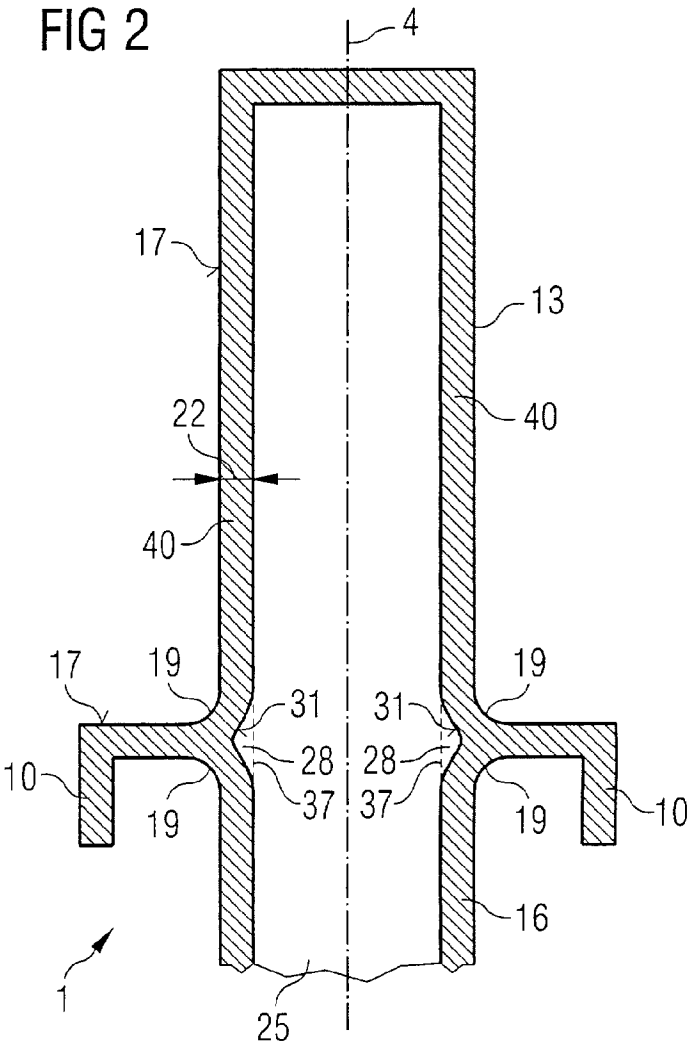
FIGS. 2 and 3 illustrate a turbine blade or vane according to an embodiment of the present invention.

Identical reference numerals have the same meaning throughout the various figures.

Figure 1:
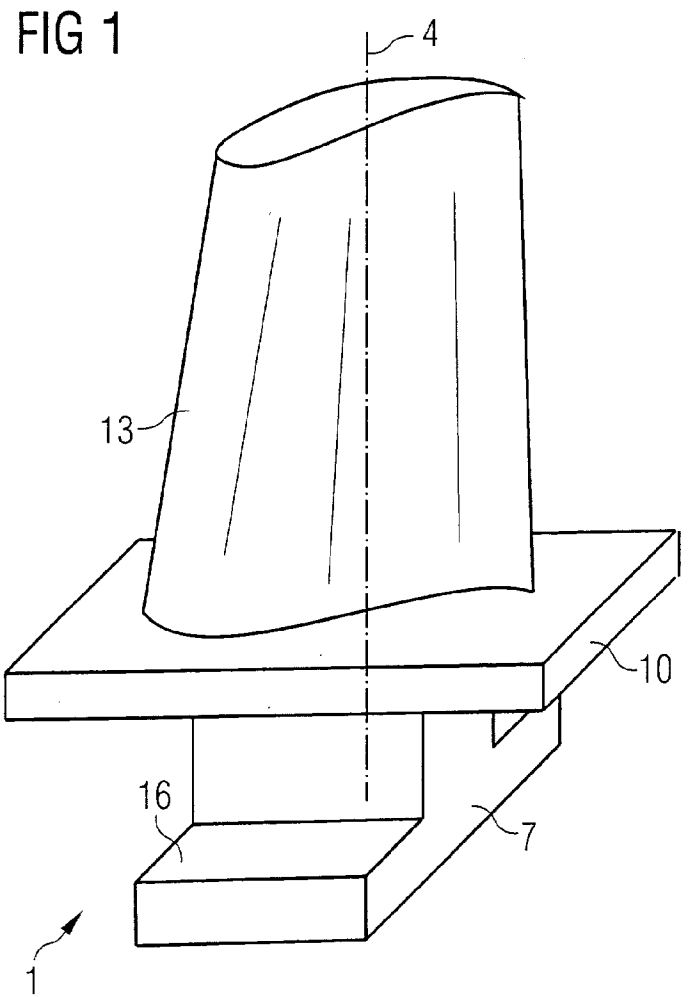
FIG. 1 illustrates a turbine blade or vane.

FIG. 1 illustrates a perspective view of a rotor blade 1 which extends along a radial axis 4. The rotor blade 1 has, in succession along the radial axis 4, a securing region 7, an adjoining blade platform 10 and a main blade region 13.

In the securing region 7 there is a blade root 16 which is used to secure the rotor blade 1 to a shaft (not shown) of a turbomachine (likewise not shown). The blade root 16 is designed, for example, as a hammerhead. Other configurations are possible. By way of example, solid metallic materials, in particular cobalt-base or nickel-base superalloys, are used in the regions 7, 10, 13.

The rotor blade may in this case be produced by a casting process, by a forging process, by a milling process or by combinations thereof.

FIG. 2 illustrates a section on the radial axis 4 in FIG. 1. The turbine blade or vane 1 according to an embodiment of the present invention, in particular a gas turbine blade or vane, is in this case, for example, a rotor blade 1 which is designed to be hollow in the interior, i.e. it has a cavity 25 or at least a passage 25, in particular a cooling passage 25.

Therefore, the turbine blade 1 has a blade wall thickness 22 at a blade wall 40 which may vary in the radial direction.

For production reasons, there is a transition 19, which is rounded on an outer surface 17 of the turbine blade or vane 1, between the main blade or vane region 13 and the platform 10. A rounded transition 19 of this type, as seen, for example, in the direction of the radial axis 4, is present above and below the blade or vane platform 10 and also, for example, all the way round the radial axis.

As shown in FIG. 2 the turbine blade or vane 1 may be hollow in the region of the main blade region 13, the transition 19 and the platform 10. A dashed line 37 indicates the standard inner contour profile in the cavity 25 or in the passage 25 according to the prior art. Therefore, in this region, according to the prior art, the blade or vane wall thickness is significantly greater than above or below the transition 19, i.e. there is an accumulation of material which, on account of the higher mass, is more difficult to cool, and consequently local overheating may occur (heat-critical region).

According to an embodiment of the present invention, an inner contour profile 31, in the region of the cavity 25 or passage 25, at the radial height (radial axis 4) of the blade or vane platform 10, is matched to the contour of the outer transition 19 in such a way that the blade or vane wall thickness 22 between main blade or vane region 13 and blade or vane root 16 has an at least substantially constant blade or vane wall thickness 22.

The fact that the inner contour profile 31 is matched to the outer transition 19, i.e. is approximately equidistant with respect thereto, indicates that a bulge 28 in the region of the blade or vane platform 10 is formed in the region of the cavity 25 or passage 25. Thus, as shown in FIG. 2, a width of the cavity 25 in the main blade region 13 may be smaller than a width of the cavity 25 in the region of the platform 10 (and/or the transition 19).

Figure 3:
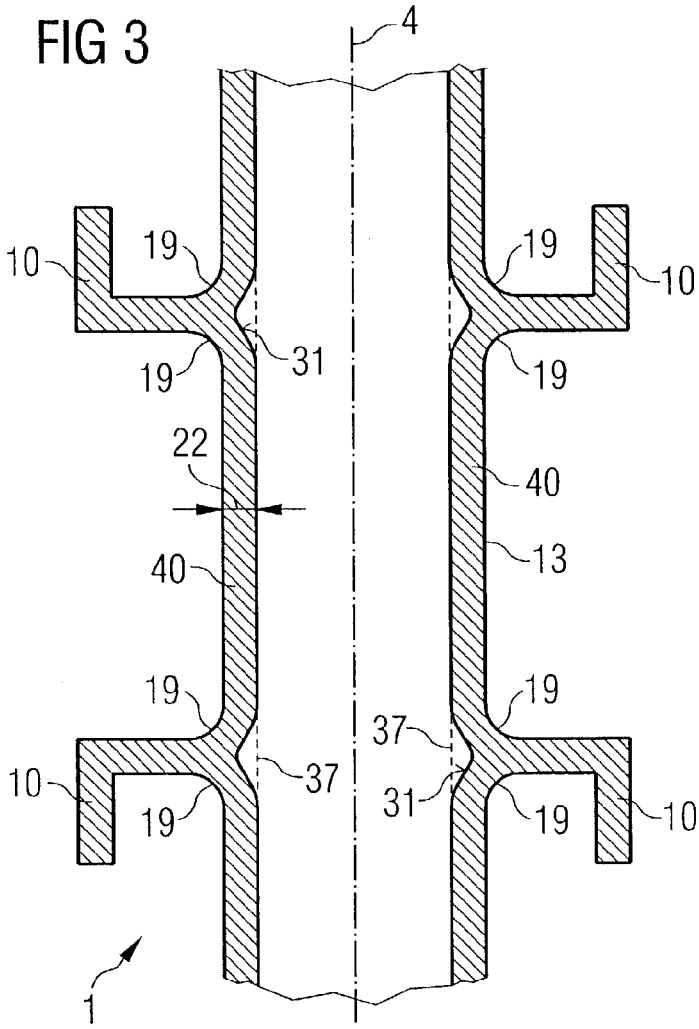

FIG. 3 illustrates a further exemplary embodiment of a turbine blade or vane 1 according to the present invention. The turbine blade or vane 1 illustrated in FIG. 3 is, for example, a guide vane which has a vane platform 10 at both radial ends. At the two vane platforms 10 there is a transition 19, which in the interior predetermines an inner contour profile 31 of the cavity 25 or passage 25, as has already been described in FIG. 2.

Figure 4:
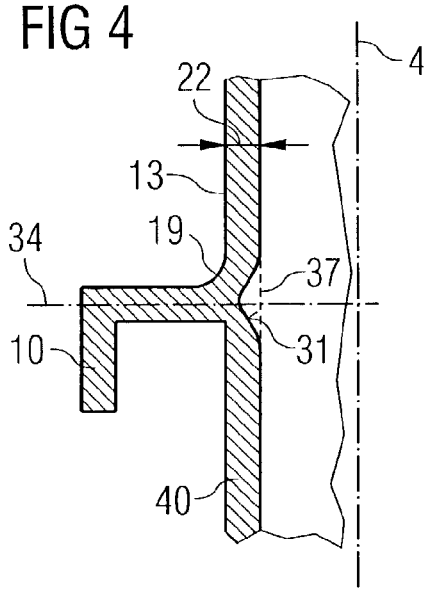
FIG. 4 illustrates a further embodiment of a turbine blade or vane according to the invention.

FIG. 4 shows a further exemplary embodiment of part of a turbine blade or vane 1 which has been formed in accordance with the present invention. The rounded transition 19 is, by way of example, only present above an axial plane 34 (perpendicular to the radial axis 4) and is, for example, only present in the upper region of the turbine blade or vane 1. In the lower region, the transition between blade or vane root

16 and platform 10 is formed virtually at right angles, since there is no heat-critical region there.

Nevertheless, the inner contour profile 31 is matched to the upper contour profile, as seen from the blade or vane root 16 in the direction of the radial axis 4, in the region of the transition 19, so that a virtually uniform blade or vane wall thickness 22 is achieved.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed:

1. A turbine blade or vane, comprising:

a main blade region;

a platform associated with the main blade region; and a transition between the main blade region and the platform, the transition having a rounded outer contour profile;

wherein the main blade region and a region of the platform and the transition have a hollow interior; and wherein an inner contour profile of the transition is matched to the rounded outer contour profile of the transition in such a manner that there is a substantially uniform blade wall thickness in the region of the transition; and wherein an inner contour profile of the platform is recessed to form a concavity.

2. The turbine blade or vane as claimed in claim 1, wherein the blade has a radial axis, and the transition is formed so as to radially surround the radial axis.

3. A turbine blade or vane, comprising:

a blade region;

at least one platform; and a transition extending between the main blade region and the at least one platform;

wherein a region of the transition and the platform has a hollow interior;

wherein the transition has a curved outer contour profile; and wherein the transition has an inner contour profile that matches the curved outer contour profile.

4. The turbine blade or vane according to claim 3, wherein a wall thickness of the blade region is substantially constant.

5. A turbine blade or vane, comprising:

a main blade region;

a platform associated with the main blade region; and a transition between the main blade region and the platform;

wherein the main blade region, the platform, and the transition define a hollow cavity;

wherein a width of the hollow cavity in the main blade region is smaller than a width of the hollow cavity in the region of at least one of the transition and the platform; and wherein an inner contour profile of the platform is recessed to form a concavity.

* * * * *